US009176436B2

(12) United States Patent
Katagiri et al.

(10) Patent No.: US 9,176,436 B2
(45) Date of Patent: Nov. 3, 2015

(54) IMAGE FORMING APPARATUS WITH A BRUSH MEMBER CONFIGURED TO CHARGE UNTRANSFERRED DEVELOPER MATERIAL

(71) Applicant: CANON KABUSHIKI KAISHA, Tokyo (JP)

(72) Inventors: Shinji Katagiri, Yokohama (JP); Yuji Kawaguchi, Tokyo (JP); Masaru Ohno, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/651,540

(22) Filed: Oct. 15, 2012

(65) Prior Publication Data

US 2013/0108313 A1 May 2, 2013

(30) Foreign Application Priority Data

Oct. 27, 2011 (WO) ..... PCT/JP2011/074761

(51) Int. Cl.
*G03G 15/16* (2006.01)

(52) U.S. Cl.
CPC ..... *G03G 15/1615* (2013.01); *G03G 15/161* (2013.01)

(58) Field of Classification Search
CPC ..... G03G 15/161; G03G 15/1615
USPC ..... 399/101, 353–354
See application file for complete search history.

(56) References Cited

U.S. PATENT DOCUMENTS

| | | | | |
|---|---|---|---|---|
| 5,732,310 | A * | 3/1998 | Hiroshima et al. | 399/101 |
| 5,765,082 | A * | 6/1998 | Numazu et al. | 399/299 |
| 6,229,980 | B1 * | 5/2001 | Ogawa et al. | 399/283 |
| 7,519,309 | B2 * | 4/2009 | Miyamoto et al. | 399/101 |
| 7,590,368 | B2 * | 9/2009 | Kamijo et al. | 399/101 |
| 8,027,612 | B2 * | 9/2011 | Soda | 399/101 |
| 2009/0232530 | A1 * | 9/2009 | Saito et al. | 399/50 |
| 2011/0150532 | A1 * | 6/2011 | Shimura et al. | 399/175 |
| 2012/0027453 | A1 * | 2/2012 | Watanabe et al. | 399/101 |
| 2012/0224870 | A1 * | 9/2012 | Kikuchi et al. | 399/44 |
| 2013/0315616 | A1 * | 11/2013 | Ohno et al. | 399/101 |
| 2014/0105626 | A1 * | 4/2014 | Ohno et al. | 399/66 |

FOREIGN PATENT DOCUMENTS

| | | | |
|---|---|---|---|
| CN | 1139221 | A | 1/1997 |
| CN | 1892495 | A | 1/2007 |
| CN | 1987681 | A | 6/2007 |
| CN | 101014910 | A | 8/2007 |
| CN | 101055457 | A | 10/2007 |
| CN | 101055458 | A | 10/2007 |

(Continued)

*Primary Examiner* — Clayton E Laballe
*Assistant Examiner* — Trevor J Bervik
(74) *Attorney, Agent, or Firm* — Canon U.S.A., Inc. IP Division

(57) ABSTRACT

When secondary-transfer residual toner adheres to a brush member, the secondary-transfer residual toner is concentrated on an end of the brush member and it is difficult to uniformly charge the secondary-transfer residual toner. The secondary-transfer residual toner can be recovered to the roots of conductive fibers of the brush member by satisfying the relationship Rb≥Ri, where Rb (Ω) is a resistance value of the brush member and Ri (Ω) is a resistance value of an intermediate transfer member in an area where the intermediate transfer member is in contact with the brush member.

13 Claims, 9 Drawing Sheets

(56) References Cited

FOREIGN PATENT DOCUMENTS

| | | | |
|---|---|---|---|
| CN | 101520624 | A | 9/2009 |
| CN | 101727036 | A | 6/2010 |
| CN | 102103340 | A | 6/2011 |
| JP | 9-044007 | A | 2/1997 |
| JP | 9-050167 | A | 2/1997 |
| JP | 2003-223055 | A | 8/2003 |
| JP | 2006-133472 | A | 5/2006 |
| JP | 2006-184361 | A | 7/2006 |
| JP | 2008-309906 | A | 12/2008 |
| JP | 2009-186764 | A | 8/2009 |
| JP | 2009-205012 | A | 9/2009 |
| JP | 2011-128380 | A | 6/2011 |
| WO | 2006/028043 | A1 | 3/2006 |

* cited by examiner

IMAGE FORMING APPARATUS WITH A BRUSH MEMBER CONFIGURED TO CHARGE UNTRANSFERRED DEVELOPER MATERIAL

BACKGROUND OF THE INVENTION

1. Field of the Invention

The present invention relates to a color image forming apparatus that uses an electrophotographic process etc.

2. Description of the Related Art

In an image forming apparatus that includes photosensitive drums for yellow (Y), magenta (M), cyan (C), and black (Bk) colors arranged in series, toner images of the respective colors are sequentially primary-transferred in a superimposed manner onto an intermediate transfer member. Then, the toner images are finally secondary-transferred together from the intermediate transfer member onto a recording medium. Such an image forming apparatus has been known as a copier or laser beam printer.

Toner remaining on the intermediate transfer member without being secondary-transferred from the intermediate transfer member to the recording material (hereinafter referred to as secondary-transfer residual toner) needs to be recovered from the intermediate transfer member before the toner images are secondary-transferred to the next recording material. As a configuration for recovering secondary-transfer residual toner, Japanese Patent Laid-Open No. 9-50167 discloses a configuration in which secondary-transfer residual toner is charged by a charging unit and recovered from an intermediate transfer member. Specifically, after the secondary-transfer residual toner is charged by the charging unit with a polarity opposite that of toner in a charged state during development, the charged secondary-transfer residual toner is moved from the intermediate transfer member to a photosensitive drum for recovery. The secondary-transfer residual toner moved to the photosensitive drum is recovered by a cleaning unit for the photosensitive drum.

Japanese Patent Laid-Open No. 2009-205012 discloses a configuration that uses a brush member as a charging unit. Secondary-transfer residual toner on an intermediate transfer member may be deposited in layers. To uniformly charge the secondary-transfer residual toner deposited in layers, the configuration disclosed in PTL 2 uses the brush member to charge the secondary-transfer residual toner deposited in layers on the intermediate transfer member while distributing the secondary-transfer residual toner.

However, adhesion of the secondary-transfer residual toner to the brush member may degrade the performance of charging the secondary-transfer residual toner. The degradation in charging performance of the brush member makes it difficult to equalize electric charges of the secondary-transfer residual toner. As a result, the secondary-transfer residual toner may not be able to be recovered from the intermediate transfer member.

The charging performance of the brush member may be degraded, because when the secondary-transfer residual toner is charged by the brush member, adhesion of the secondary-transfer residual toner is concentrated on the tips of conductive fibers of the brush member. If a large amount of secondary-transfer residual toner adheres to the tips of the conductive fibers, it is difficult to distribute the secondary-transfer residual toner deposited in layers on the intermediate transfer member, and is difficult to uniformly charge the secondary-transfer residual toner. If the secondary-transfer residual toner cannot be uniformly charged, it is difficult to recover the secondary-transfer residual toner from the intermediate transfer member.

This phenomenon tends to occur particularly when the electric charge of toner is low, or when the amount of secondary-transfer residual toner is increased by a reduction in transfer efficiency caused by use of paper with rough surface nature, such as rough paper.

In view of the circumstances described above, an aspect of the present invention is to provide an image forming apparatus that can suppress, even if secondary-transfer residual toner adheres to a brush member, concentration of the adhering secondary-transfer residual toner on the tips of the brush member, and can efficiently recover the secondary-transfer residual toner from an intermediate transfer member.

SUMMARY OF THE INVENTION

The aspect described above is achieved by an electrophotographic image forming apparatus according to the present invention.

An image forming apparatus includes an image bearing member configured to bear a toner image; a rotatable intermediate transfer member; a primary transfer member configured to form a primary transfer portion together with the image bearing member, with the intermediate transfer member interposed therebetween, to primary-transfer the toner image from the image bearing member to the intermediate transfer member; a secondary transfer member configured to form a secondary transfer portion together with the intermediate transfer member to secondary-transfer the toner image from the intermediate transfer member to a recording material; a brush member configured to come into contact with residual toner remaining on the intermediate transfer member without being secondary-transferred to the recording material at the secondary transfer portion; and a power supply unit configured to apply a voltage to the brush member. The residual toner is charged by the brush member to which a voltage of predetermined polarity is applied by the power supply unit, and the charged residual toner is moved from the intermediate transfer member to the image bearing member at the primary transfer portion. The relationship $Rb \geq Ri$ is satisfied, where Rb (Ω) is a resistance value of the brush member and Ri (Ω) is a resistance value of the intermediate transfer member at a contact portion in contact with the brush member.

Further features of the present invention will become apparent from the following description of exemplary embodiments with reference to the attached drawings.

DETAILED DESCRIPTION OF THE EMBODIMENTS

Various exemplary embodiments, features, and aspects of the invention will now be described in detail with reference to the drawings.

Figure 1:
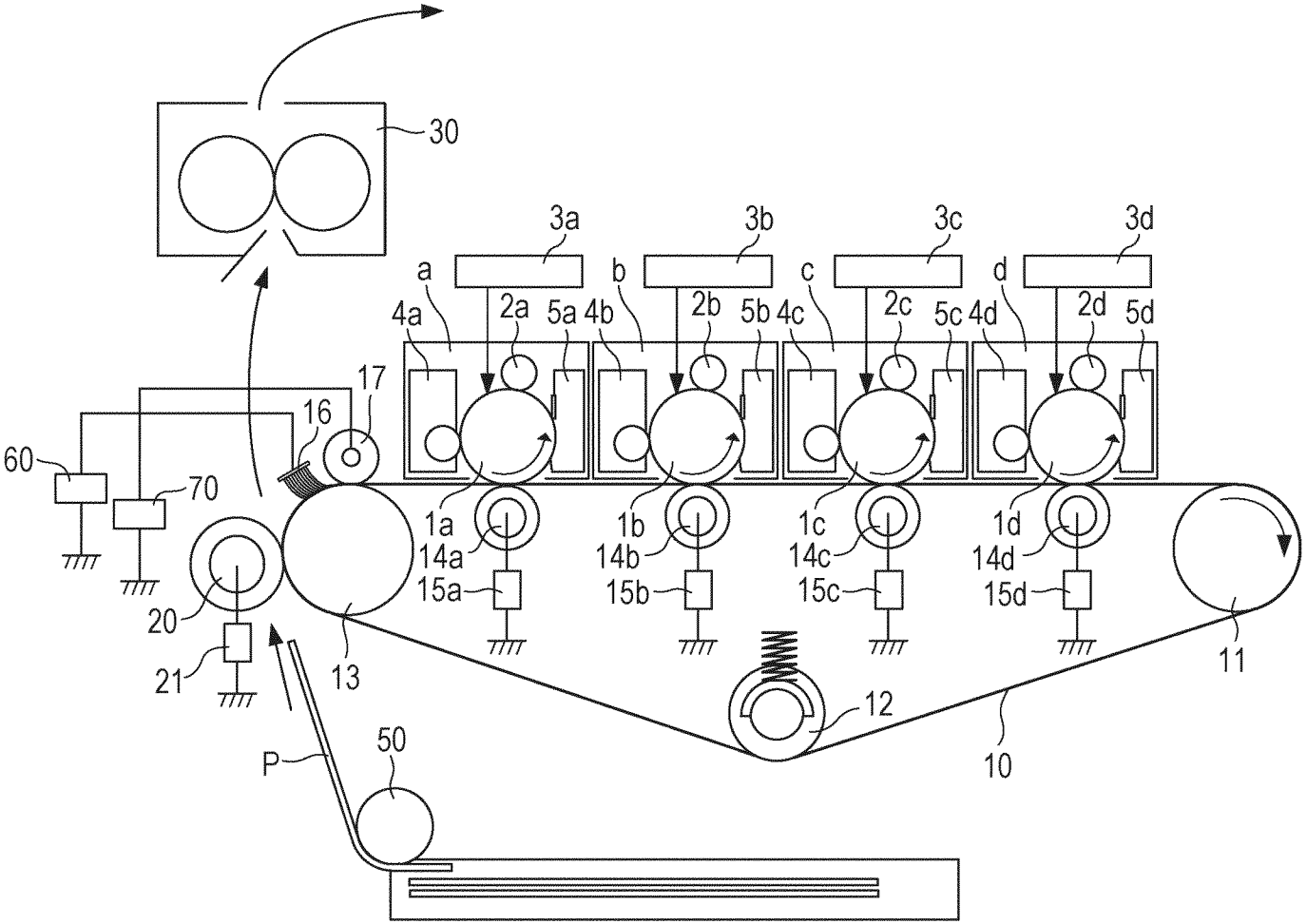
FIG. 1 illustrates an example image forming apparatus according to a first embodiment.

FIG. 1 is a schematic view illustrating a color image forming apparatus. A configuration and operation of an image forming apparatus according to the present embodiment will be described with reference to FIG. 1. The image forming apparatus of the present embodiment is a so-called tandem-type printer that includes image forming stations "a" to "d". A first image forming station "a" forms a yellow (Y) image, a second image forming station "b" forms a magenta (M) image, a third image forming station "c" forms a cyan (C) image, and a fourth image forming station "d" forms a black (Bk) image. Configurations of the image forming stations are the same, except for the colors of toners contained therein. The following description will be made using the first image forming station "a".

The image forming station "a" includes a drum-shaped electrophotographic photosensitive member (hereinafter referred to as a photosensitive drum) 1*a*, a charging roller 2*a* serving as a charging member for an image bearing member (or photosensitive drum), a developing unit 4*a*, and a cleaning device 5*a*. The photosensitive drum 1*a* is an image bearing member driven to rotate at a predetermined circumferential speed (or processing speed) in the direction of arrow and configured to bear a toner image. The developing unit 4*a* is a device that contains yellow toner and develops the yellow toner on the photosensitive drum 1*a*. The cleaning device 5*a* is a component for recovering toner adhering to the photosensitive drum 1*a*. In the present embodiment, the cleaning device 5*a* includes a cleaning blade that serves as a cleaning member in contact with the photosensitive drum 1*a*, and a waste toner box that contains toner recovered by the cleaning blade.

The photosensitive drum 1*a* is driven to rotate when an image forming operation is started by an image signal. During the process of rotation, the photosensitive drum 1*a* is uniformly charged by the charging roller 2*a* with a predetermined polarity (or negative polarity in the present embodiment) at a predetermined potential, and is exposed to light by an exposure unit 3*a* in accordance with the image signal. Thus, an electrostatic latent image is formed, which corresponds to a yellow color component image of an intended color image. Next, the electrostatic latent image is developed at a developing position by the developing unit (yellow developing unit) 4*a* and visualized as a yellow toner image. A normal charging polarity of toner contained in the developing unit is a negative polarity.

An intermediate transfer belt 10 serving as a rotatable intermediate transfer member is disposed opposite the image forming stations "a" to "d". The image forming stations are arranged in a row along the rotational direction of the intermediate transfer member. The intermediate transfer belt 10 is an endless belt formed by adding a conductive agent to resin material so as to give conductivity thereto. The intermediate transfer belt 10 is stretched around the following three shafts: a driving roller 11, a tension roller 12, and a secondary-transfer opposite roller 13. The intermediate transfer belt 10 is stretched by the tension roller 12 under a total tension of 60 N. The intermediate transfer belt 10 is driven to rotate at substantially the same circumferential speed as the photosensitive drums 1, and in the same direction as the photosensitive drums 1 at opposite portions in contact with the photosensitive drums 1.

Primary transfer rollers 14*a* to 14*d* each serving as a primary transfer member have an outside diameter of 12 mm. The primary transfer rollers 14*a* to 14*d* each are formed by covering a nickel-plated steel rod having an outer diameter of 6 mm with foam sponge. The foam sponge is made primarily of nitrile-butadiene rubber (NBR) and epichlorohydrin rubber, and adjusted to a volume resistivity of $10^7$ Ω·cm and a thickness of 3 mm. The primary transfer rollers 14*a* to 14*d* are brought into contact with the photosensitive drums 1*a* to 1*d*, with the intermediate transfer belt 10 interposed therebetween, by applying a pressure of 9.8 N. Thus, the primary transfer rollers 14*a* to 14*d* are driven to rotate as the intermediate transfer belt 10 rotates.

In the process of passing through a primary transfer portion (hereinafter referred to as a primary transfer nip) formed by the photosensitive drum 1*a* and the intermediate transfer belt 10, a yellow toner image formed on the photosensitive drum 1*a* is transferred (primary-transferred) onto the intermediate transfer belt 10 by the primary transfer roller 14*a* to which a primary transfer voltage (1500 V) is applied by a primary-transfer power supply 15*a*. Primary-transfer residual toner on the surface of the photosensitive drum 1*a* is removed by the cleaning device 5*a*.

Likewise, a magenta (second color) toner image, a cyan (third color) toner image, and a black (fourth color) toner image are formed by the second, third, and fourth image forming stations "b", "c", and "d", respectively, and sequentially transferred in a superimposed manner onto the intermediate transfer belt 10. Thus, a composite color image corresponding to an intended color image can be obtained.

In the process of passing through a secondary transfer nip formed by the intermediate transfer belt 10 and a secondary transfer roller 20, the toner images of four colors on the intermediate transfer belt 10 are transferred (secondary-transferred) together onto a surface of a recording material P fed by a paper feeder 50.

The secondary transfer roller 20 serving as a secondary transfer member has an outside diameter of 18 mm. The secondary transfer roller 20 is formed by covering a nickel-plated steel rod having an outer diameter of 8 mm with foam sponge. The foam sponge is made primarily of NBR and epichlorohydrin rubber and adjusted to a volume resistivity of $10^8$ Ω·cm and a thickness of 5 mm. The secondary transfer roller 20 is brought into contact with the intermediate transfer belt 10 by applying a pressure of 50 N, and forms a secondary transfer portion (hereinafter referred to as a secondary transfer nip). The secondary transfer roller 20 is driven to rotate as the intermediate transfer belt 10 rotates. A voltage of 2500 V is applied to the secondary transfer roller 20 while toner on the intermediate transfer belt 10 is being secondary-transferred to a recording material, such as paper.

Then, the recording material P bearing toner images of four colors is introduced into a fixing device 30 and subjected to heat and pressure. Thus, the toners of four colors are melted, mixed, and fixed onto the recording material P. A full-color print image is thus formed by the operation described above.

Next, a method for recovering secondary-transfer residual toner remaining without being secondary-transferred from the intermediate transfer belt 10 to the recording material will be described. The image forming apparatus of the present embodiment recovers secondary-transfer residual toner by charging the secondary-transfer residual toner with a charging unit and moving the charged secondary-transfer residual toner from the intermediate transfer belt 10 to the photosensitive drum 1.

As a charging unit for charging the secondary-transfer residual toner, the image forming apparatus includes a conductive brush 16 serving as a brush member. In the rotational direction of the intermediate transfer belt 10, the conductive brush 16 is disposed downstream of the secondary transfer nip and upstream of the primary transfer nips. As an auxiliary charging unit, the image forming apparatus includes a conductive roller 17 disposed downstream of the conductive brush 16 and upstream of the primary transfer nips.

The conductive brush 16 has conductive fibers. A brush high-voltage power supply 60 serving as a power supply unit for the conductive brush 16 applies, to the conductive brush 16, a voltage having a polarity (or positive polarity in the present embodiment) opposite the normal charging polarity of toner to charge the secondary-transfer residual toner. Alternatively, the brush high-voltage power supply 60 may apply, to the conductive brush 16, a voltage having a polarity (or negative polarity in the present embodiment) equal to the normal charging polarity of toner. The brush high-voltage power supply 60 applies only a direct-current voltage to the conductive brush 16. This is to suppress scattering of secondary-transfer residual toner from the intermediate transfer belt 10. Although the brush high-voltage power supply 60 may be configured to apply only an alternating-current voltage to the conductive brush 16, application of an alternating-current voltage causes easy scattering of secondary-transfer residual toner from the intermediate transfer belt 10.

An end of the conductive brush 16 is fixed at an ingress length of about 1.0 mm with respect to the surface of the intermediate transfer belt 10, and is different in circumferential speed from the intermediate transfer member. A configuration of the conductive brush 16, which characterizes the present embodiment, will be described later on.

An elastic roller made primarily of polyurethane rubber having a volume resistivity of $10^9$ Ω·cm is used as the conductive roller 17. The conductive roller 17 is pressed against the secondary-transfer opposite roller 13, with the intermediate transfer belt 10 interposed therebetween, by a spring (not shown) at a total pressure of 9.8 N. The conductive roller 17 is driven to rotate as the intermediate transfer belt 10 rotates. A roller high-voltage power supply 70 applies a voltage of 1500 V to the conductive roller 17 to charge the secondary-transfer residual toner again. Although polyurethane rubber is used to form the conductive roller 17 in the present embodiment, the material of the conductive roller 17 is not particularly limited to this. For example, nitrile-butadiene rubber (NBR), ethylene-propylene rubber (EPDM), or epichlorohydrin may be used to form the conductive roller 17.

A method for recovering secondary-transfer residual toner from the intermediate transfer belt 10, on the basis of the configuration described above, will be described with reference to FIG. 2.

Figure 2:
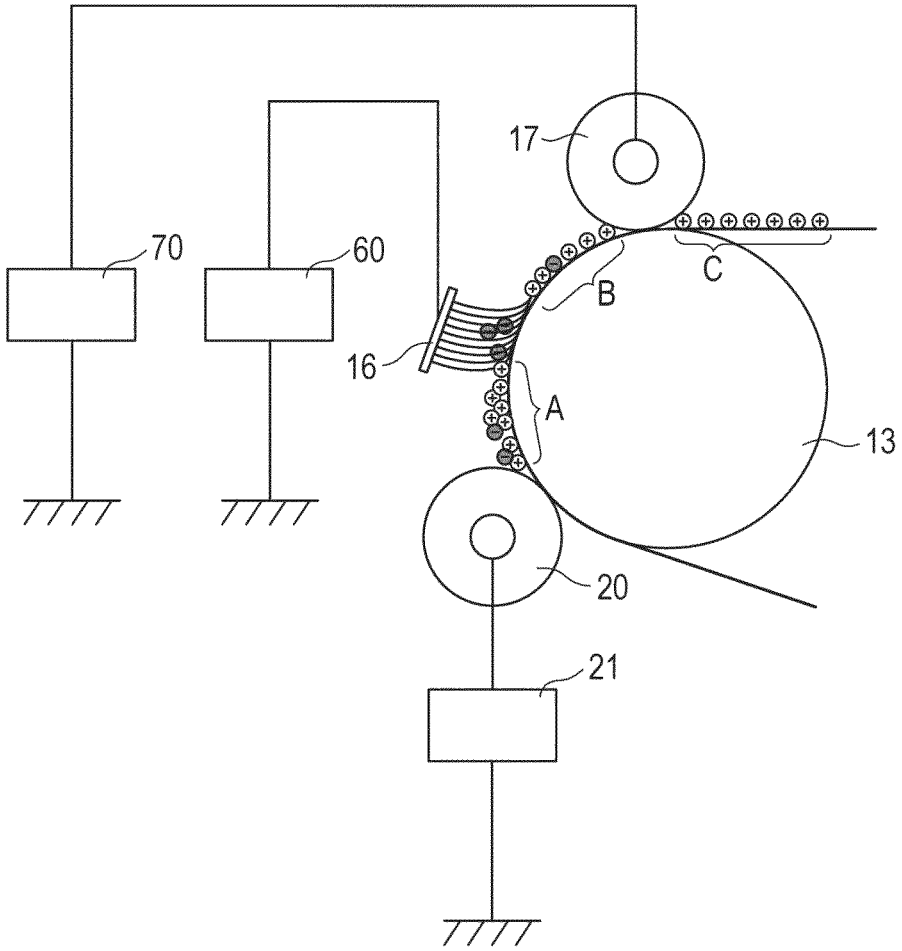
FIG. 2 illustrates an example method for recovering secondary-transfer residual toner according to an embodiment.

As illustrated in FIG. 2, secondary-transfer residual toner remaining on the intermediate transfer belt 10 after secondary transfer has both positive and negative polarities, because of the effect of a voltage of positive polarity applied to the secondary transfer roller 20. Due to surface irregularities of the recording material P, secondary-transfer residual toner is locally deposited in layers on the intermediate transfer belt 10 (see A in FIG. 2).

The conductive brush 16 located upstream of the secondary-transfer residual toner remaining on the intermediate transfer belt 10 in the rotational direction of the intermediate transfer belt 10 is fixed with respect to the rotating intermediate transfer belt 10, and is disposed at a predetermined ingress length with respect to the intermediate transfer belt 10. Therefore, when passing through the conductive brush 16, the secondary-transfer residual toner deposited in layers on the intermediate transfer belt 10 is distributed to a height of substantially one layer, because of a difference in circumferential speed between the conductive brush 16 and the intermediate transfer belt 10 (see B in FIG. 2).

The secondary-transfer residual toner is recovered by applying a voltage of positive polarity from the brush high-voltage power supply 60 to the conductive brush 16 and performing constant current control (10 μA in the present embodiment) on the conductive brush 16. The secondary-transfer residual toner remaining on the intermediate transfer belt 10 without being recovered by the conductive brush 16 is positively charged when passing through the conductive brush 16.

The secondary-transfer residual toner recovered by the conductive brush 16 is moved from the conductive brush 16 to the intermediate transfer belt 10 by executing a discharge mode (described below), and moved from the intermediate transfer belt 10 to the photosensitive drum 1*a* at the primary transfer nip. Thus, when charging the secondary-transfer residual toner, the conductive brush 16 temporarily recovers the secondary-transfer residual toner.

After passing through the conductive brush 16, the secondary-transfer residual toner moves in the rotational direction of the intermediate transfer belt 10 to reach the conductive roller 17, to which a voltage (1500 V in the present embodiment) of positive polarity is applied by the roller high-voltage power supply 70. After passing through the conductive brush 16 and positively charged, the secondary-transfer residual toner is further charged when passing through the conductive roller 17 (see C in FIG. 2). After optimum electric charge is given, the secondary-transfer residual toner is moved from the intermediate transfer belt 10 to the photosensitive drum 1*a* by a voltage of positive polarity applied at the primary transfer portion to the primary transfer roller 14*a*, and is recovered by the cleaning device 5*a* disposed on the photosensitive drum 1*a*.

When image formation is performed successively on a plurality of recording materials, positively-charged secondary-transfer residual toner can be recovered from the intermediate transfer belt 10 simultaneously with primary transfer from the photosensitive drum 1 onto the next recording material at the primary transfer nip.

In the present embodiment, the conductive roller 17 serving as an auxiliary charging unit is disposed downstream of the conductive brush 16 in the rotational direction of the intermediate transfer belt 10. This is to equalize the amount of charge after toner passes through the conductive brush 16. When the amount of charge is equalized, toner can be easily moved from the intermediate transfer belt 10 to the photosensitive drum 1 at the primary transfer nip. If the amount of secondary-transfer residual toner is large, the amount of toner remaining on the intermediate transfer belt 10 without being recovered by the conductive brush 16 is also large. As in the present embodiment, if charged again by the conductive roller 17 serving as an auxiliary charging unit, the secondary-transfer residual toner can be reliably recovered at the primary transfer nip.

Characteristics of the present embodiment will now be described with reference to FIG. 3A, FIG. 3B, FIG. 4A, and FIG. 4B.

The present embodiment is characterized in that, in the image forming apparatus where secondary-transfer residual toner on the intermediate transfer belt 10 is charged by the conductive brush 16, the relationship Rb≥Ri is satisfied, where Rb (Ω) is a resistance value of the conductive brush 16 and Ri (Ω) is a resistance of the intermediate transfer belt 10 in an area where the intermediate transfer belt 10 is in contact with the conductive brush 16.

Specifically, the intermediate transfer belt 10 used is an endless polyimide resin member having a thickness of 90 μm and adjusted to a volume resistivity of $1\times10^9$ Ω·cm by mixing carbon as a conductive agent. The intermediate transfer belt 10 is electrically characterized in that it exhibits electronic conductivity and that its resistance value does not vary significantly with changes in temperature and humidity in atmosphere.

For better transfer performance, the volume resistivity preferably ranges from $1\times10^8$ Ω·cm to $1\times10^{10}$ Ω·cm. If the volume resistivity is smaller than $10^8$ Ω·cm, a current flowing into the primary transfer portion from an adjacent station tends to cause an image defect. If the volume resistivity is larger than $10^{10}$ Ω·cm, charging the intermediate transfer belt increases the surface potential of the belt, and the resulting abnormal discharge between the belt and the photosensitive drum causes an image defect. The volume resistivity is measured using Hiresta-UP (MCP-HT450) and a measurement probe UR (MCP-HTP12 type) manufactured by Mitsubishi Chemical Corporation. The measurement is performed for 10 seconds at a room temperature of 23° C., a room humidity of 50%, and an applied voltage of 500 V.

Although polyimide resin is used as a material of the intermediate transfer belt 10 in the present embodiment, the intermediate transfer belt 10 may be made of any thermoplastic resin. For example, the material of the intermediate transfer belt 10 may be polyester, polycarbonate, polyarylate, acrylonitrile-butadiene-styrene (ABS) copolymer, polyphenylene sulfide (PPS), polyvinylidene fluoride (PVdF), or a mixture of some of these resins.

Figure 3A:
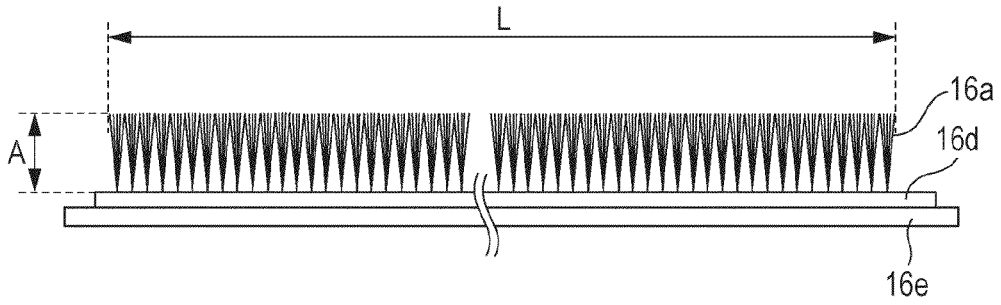
FIG. 3A illustrates an example configuration of a conductive brush from a longitudinal direction of an intermediate transfer belt.
Figure 3B:
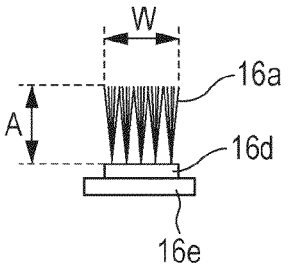
FIG. 3B illustrates the conductive brush from a rotational direction of the intermediate transfer belt.

The conductive brush 16 serving as a brush member will now be described with reference to FIG. 3A and FIG. 3B. FIG. 3A is a cross-sectional view of the conductive brush 16 as viewed in the rotational direction of the intermediate transfer belt 10. In FIG. 3A, reference character L denotes a length of the conductive brush 16 in the longitudinal direction orthogonal to the rotational direction of the intermediate transfer belt 10, and reference character A denotes a height of the conductive brush. FIG. 3B is a cross-sectional view of FIG. 3A. In FIG. 3B, reference character W denotes a length of the conductive brush 16 in the rotational direction of the intermediate transfer belt 10.

Conductive fibers 16*a* of the conductive brush 16 are made primarily of nylon, use carbon as a conductive agent, and have a single yarn fineness of 300 T/60 F (5 dtex). The single yarn fineness here indicates that one yarn is composed of 60 filaments of fibers and weighs 300 T (decitex: the weight per 10000 m is 300 g).

As illustrated in FIG. 3A and FIG. 3B, the conductive brush 16 formed as a bundle of the conductive fibers 16*a* is produced by weaving the conductive fibers 16*a* into a ground fabric 16*d* of insulating nylon, which is bonded by a conductive adhesive onto an SUS sheet 16*e* having a thickness of 1 mm. That is, the ground fabric 16*d* serves as a supporting unit, by which the conductive fibers 16*a* are supported at one end. At the other end not supported by the supporting unit, the conductive fibers 16*a* slide over the intermediate transfer belt 10. The brush high-voltage power supply 60 applies a voltage to the SUS sheet 16*e*, so that the voltage is applied to the conductive fibers 16*a* through the ground fabric 16*d* bonded to the SUS sheet 16*e* by the conductive adhesive.

The density of the conductive fibers 16*a* is 100 kF/inch$^2$. The conductive fibers 16*a* are 5 mm in length A, 225 mm in longitudinal width L, and 4 mm in width W in the conveying direction. The conductive fibers 16*a* are implanted in five rows in the rotational direction of the intermediate transfer belt 10.

Figure 4A:
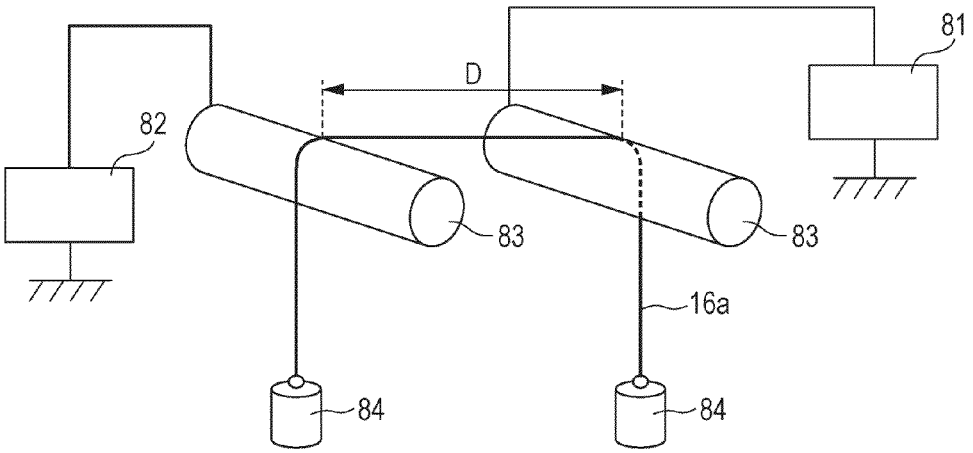
FIG. 4A illustrates an example method for measuring resistance of a conductive fiber.

FIG. 4A illustrates a method for measuring a resistance of one conductive fiber 16*a* per unit length (Ω/cm). As illustrated, the conductive fiber 16*a* to be measured is stretched between two ϕ5 metal rollers 83 arranged with a width of 10 mm (D). A load is applied to each end of the conductive fiber 16*a* by a weight 84 having a weight of 100 g. In this state, a measurement power supply 81 applies a voltage of 200 V through the metal roller 83 to the conductive fiber 16*a*. Then, the current value is read by a measurement ammeter 82 to calculate a resistance value of the conductive fiber 16*a* per 10 mm (or 1 cm) (Ω/cm). In view of the relationship with the belt resistance which characterizes the present embodiment, the resistance of the conductive fiber preferably ranges from $1\times10^{10}$ Ω/cm to $1\times10^{13}$ Ω/cm. This will be described in detail later on.

Figure 4B:
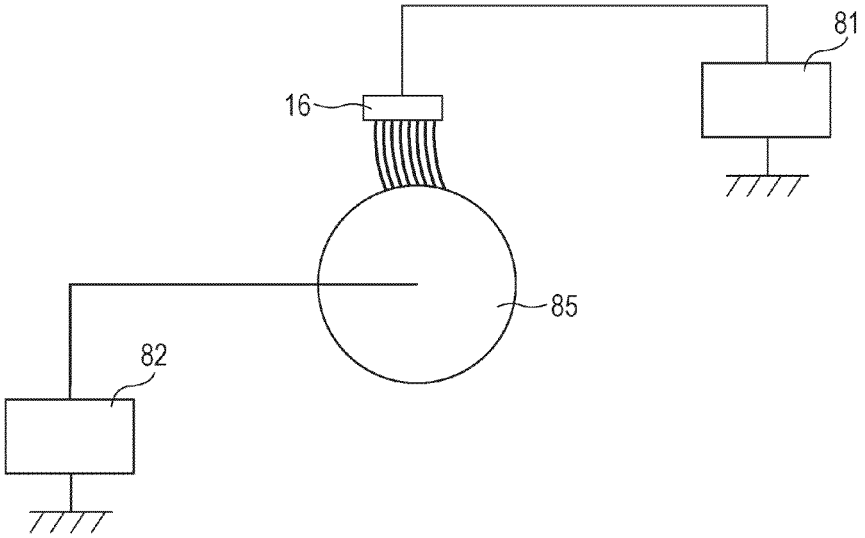
FIG. 4B illustrates an example method for measuring resistance of the conductive brush.

As described above, the conductive brush 16 serving as a brush member is configured such that the plurality of conductive fibers 16*a* come into contact with the intermediate transfer belt 10. The overall resistance of the conductive brush 16 is determined, by measurement, by taking into account variations in resistance of the conductive fibers 16*a*. A method for measuring the resistance value Rb of the conductive brush will be described with reference to FIG. 4B. As illustrated in FIG. 4B, the method for measuring the resistance value Rb (Ω) of the conductive brush 16 involves bringing the conductive brush 16 to be measured into contact with a ϕ30 metal roller 85 at an ingress length of 1.0 mm, applying a voltage of 200 V from the power supply 81 to the conductive brush 16, reading the current value with the ammeter 82, and calculating the resistance value (Ω) of the conductive brush 16.

The resistance value Ri (Ω) of the intermediate transfer belt 10 at a portion (or contact portion) where the intermediate transfer belt 10 is in contact with the conductive brush 16 can be determined by the following manner. The area of the contact portion where the intermediate transfer belt 10 is in contact with the conductive brush 16 can be determined from the contact area of the conductive brush 16 illustrated in FIG. 3A and FIG. 3B. In the present embodiment, the conductive brush 16 is 4 mm in width W in the belt rotational direction and 225 mm in longitudinal width L.

Thus, the resistance value Ri of the intermediate transfer belt 10 can be determined from the volume resistivity of the intermediate transfer belt, and the thickness and the contact area of the intermediate transfer belt 10. For example, if the intermediate transfer belt 10 is $1\times10^9$ Ω·cm in volume resistivity and 90 μm in thickness, the resistance value Ri of the intermediate transfer belt 10 is $1\times10^9$ Ω·cm×90 μm/(4 mm×225 mm)=$1.0\times10^5$Ω.

The present embodiment is characterized in that the resistance value Rb (Ω) of the conductive brush 16 and the resistance value Ri (Ω) of the intermediate transfer belt 10 in the area where the intermediate transfer belt 10 is in contact with the conductive brush 16 satisfy the relationship Rb≥Ri.

Specifically, if the intermediate transfer belt 10 having a volume resistivity ranging from $1\times10^{8}$ Ω·cm to $1\times10^{10}$ Ω·cm is selected for better transfer performance, the resistance value Ri (Ω) of the intermediate transfer belt 10 in the area of the contact portion where the intermediate transfer belt 10 is in contact with the conductive brush 16 is in the range of $1\times10^{5}$Ω to $1\times10^{7}$Ω, which is determined from the width W (4 mm), the longitudinal width L (225 mm), and the thickness (90 μm) of the intermediate transfer belt 10.

To satisfy the relationship Rb≥Ri, the conductive brush 16 is selected such that its resistance value Rb (Ω) is $1\times10^{7}$Ω to $1\times10^{9}$Ω in the measurement method described above. The upper limit of Rb is set to $10^{9}$Ω, because if a voltage necessary for positively charging the secondary-transfer residual toner is too high, the capacity of the brush high-voltage power supply 60 becomes too large. Therefore, to satisfy Rb=$1\times10^{7}$Ω to $1\times10^{9}$Ω, the conductive brush 16 used is one in which the resistance of one conductive fiber 16*a* per unit length (Ω/cm) is $1\times10^{10}$ Ω/cm to $1\times10^{13}$ Ω/cm.

In the present embodiment, the intermediate transfer belt 10 having a volume resistivity of $1\times10^{9}$ Ω·cm is used such that the resistance value Ri of the intermediate transfer belt 10 is $1.0\times10^{5}$Ω. The resistance value Rb (Ω) of the conductive brush 16 is $1.0\times10^{8}$Ω.

A function of the present embodiment will now be described with reference to FIG. 5, FIG. 6, FIG. 7A, and FIG. 7B.

The function of the present embodiment is to cause a voltage drop which allows recovery of toner at each fiber of the conductive brush 16 by using the conductive brush 16 having a resistance higher than that of the intermediate transfer belt 10. In the conductive brush 16, if a potential at the roots of the conductive fibers 16*a* (adjacent to the ground fabric 16*d*) is sufficiently higher than a potential at the tips of the conductive fibers 16*a* (adjacent to the intermediate transfer belt 10), secondary-transfer residual toner adhering to the conductive brush 16 can be moved by the potential difference from the tips to roots of the conductive fibers 16*a*.

Figure 5:
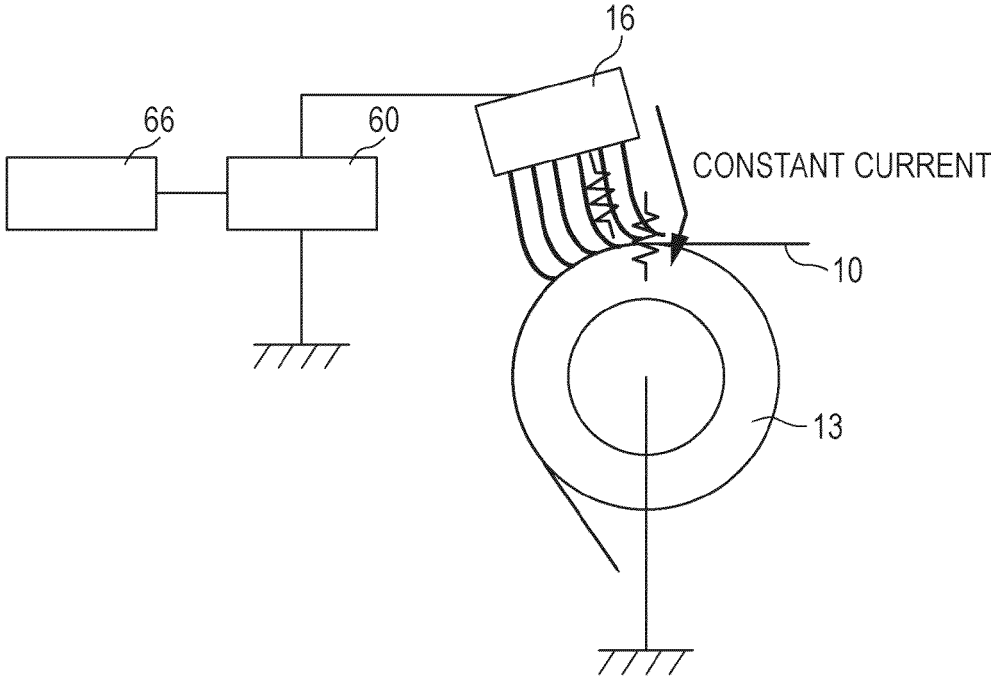
FIG. 5 illustrates an example of how secondary-transfer residual toner moves according to an embodiment.

Specifically, as illustrated in the schematic diagram of FIG. 5, the brush high-voltage power supply 60 applies a voltage to the conductive brush 16. A controller 66 that controls the brush high-voltage power supply 60 performs constant current control such a current of about 10 μA flows. A current path is formed such that current flows from the brush high-voltage power supply 60, through the conductive brush 16 and the intermediate transfer belt 10, toward the secondary-transfer opposite roller 13.

Figure 6:
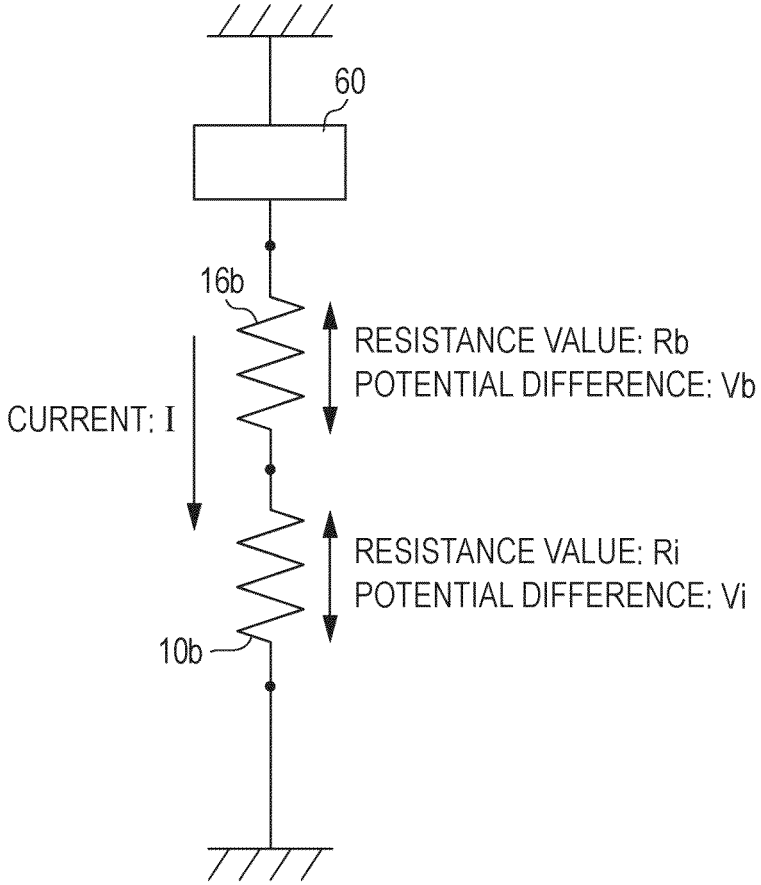
FIG. 6 illustrates an equivalent circuit of a path of current flowing through the conductive brush and the intermediate transfer belt.

FIG. 6 illustrates an equivalent circuit for describing the configuration of FIG. 5. In FIG. 6, the conductive brush 16 is represented by a resistor 16*b* having the resistance value Rb (Ω), and the intermediate transfer belt 10 is represented by a resistor 10*b* having the resistance value Ri (Ω). The resistor 16*b* and the resistor 10*b* are constant-current-controlled at I (A) by the brush high-voltage power supply 60. As illustrated in FIG. 6, the conductive brush 16 and the intermediate transfer belt 10 will be connected in series. Therefore, when I denotes current flowing in this equivalent circuit, a potential difference Vb (V) applied to the resistor 16*b* representing the conductive brush 16 is expressed as Vb=Rb×I, and a potential difference Vi applied to the resistor 10*b* representing the intermediate transfer belt 10 is expressed as Vi=Ri×I. This means that the potential difference is dependent on the resistance value.

As a result, as in the present embodiment, when the resistance value Rb of the conductive brush 16 is higher than the resistance value Ri of the intermediate transfer belt 10 (Ri≤Rb), the potential difference Vb generated at the conductive brush 16 is larger than the potential difference Vi generated at the intermediate transfer belt 10. This means that in the equivalent circuit of FIG. 6, a voltage drop occurs mainly at the conductive brush 16.

Figure 7A:
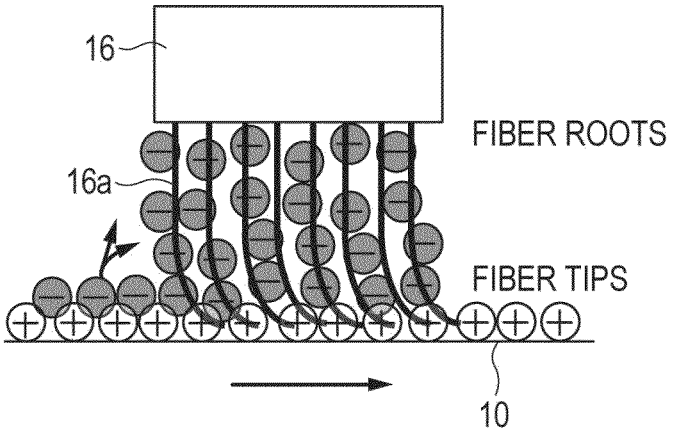
FIG. 7A illustrates an example of how secondary-transfer residual toner is recovered to the conductive brush according to an embodiment.
Figure 7B:
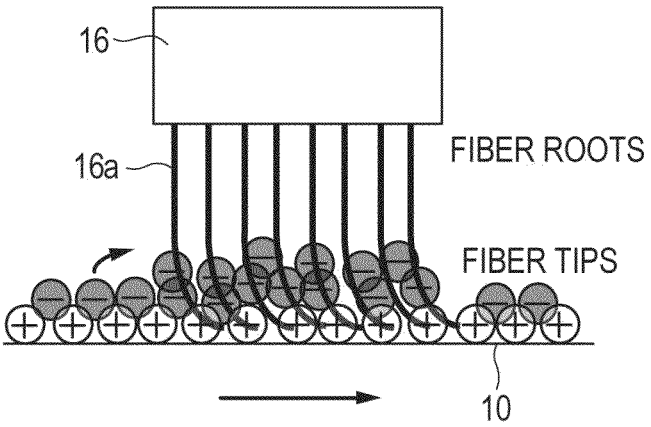
FIG. 7B illustrates an example of how secondary-transfer residual toner is recovered to the conductive brush according to a comparative example.

FIG. 7A and FIG. 7B schematically illustrate how secondary-transfer residual toner is recovered by the conductive brush 16. The direction of arrow in the drawings indicates the rotational direction of the intermediate transfer belt 10. FIG. 7A illustrates an example where the resistance value Rb of the conductive brush 16 is higher than the resistance value Ri of the intermediate transfer belt 10 (Ri≤Rb). FIG. 7B illustrates an example where the resistance value Ri of the intermediate transfer belt 10 is higher than the resistance value Rb of the conductive brush 16 (Ri>Rb).

To positively charge the secondary-transfer residual toner, the brush high-voltage power supply 60 applies a voltage of positive polarity to the conductive brush 16. Therefore, when secondary-transfer residual toner having both positive and negative polarities enters (or comes into contact with) the conductive brush 16, toner of negative polarity electrostatically adheres to the conductive brush 16.

When Ri≤Rb as in FIG. 7A, the potential difference Vb in the conductive brush 16 is larger than the potential difference Vi in the intermediate transfer belt 10. In other words, in the circuit as a whole, a voltage drop that occurs in the conductive brush 16 is dominant over that occurs in the intermediate transfer belt 10. Therefore, a voltage value (or potential of positive polarity) and an attractive force that electrostatically attracts toner increase toward the roots of the conductive fibers 16*a*. That is, by a potential difference between one end and the other end of the conductive fibers 16*a*, the secondary-transfer residual toner can be recovered to the roots of the conductive fibers 16*a*.

Thus, when attracted to the conductive brush 16, the secondary-transfer residual toner on the intermediate transfer belt 10 adheres (or is recovered) not only to the tips of the conductive fibers 16*a* but also to the roots of the conductive fibers 16*a*. That is, since the secondary-transfer residual toner on the intermediate transfer belt 10 can be recovered to the roots of the conductive fibers 16*a*, the conductive brush 16 can recover a large amount of secondary-transfer residual toner. Since a large amount of secondary-transfer residual toner is recovered by the conductive brush 16, the efficiency of the conductive brush 16 for charging the secondary-transfer residual toner on the intermediate transfer belt 10 is improved.

However, when Ri>Rb as in FIG. 7B, the potential difference Vb in the conductive brush 16 is smaller than the potential difference Vi in the intermediate transfer belt 10. In other words, in the circuit as a whole, a voltage drop that occurs in the intermediate transfer belt 10 is dominant over that occurs in the conductive brush 16. Therefore, since a potential difference between the tips and the roots of the conductive fibers 16*a* is smaller than that occurs in the intermediate transfer belt 10, the secondary-transfer residual toner is electrostatically attracted more to the intermediate transfer belt 10. Thus, as illustrated in the schematic diagram of FIG. 7B, toner adhesion is concentrated on the tips of the conductive fibers 16*a* closer in distance to the intermediate transfer belt 10. As a result, when the amount of secondary-transfer residual toner adhering to the tips exceeds a certain level, the secondary-transfer residual toner can no longer adhere to the conductive brush 16. Additionally, the efficiency of charging the secondary-transfer residual toner not adhering to the conductive brush 16 is degraded.

Table 1 shows how, when the resistance value Ri of the intermediate transfer belt in contact with the conductive brush 16 is $1\times10^7\Omega$, the potential difference Vb in the conductive brush 16 changes by varying the resistance value Rb of the conductive brush 16. Note that constant current control is performed such that a current I of 10 μA flows. The magnitude of current I is set such that the polarity of secondary-transfer residual toner on the intermediate transfer belt 10 can be reversed from negative to positive. In the present embodiment, the current I is preferably from 10 μA to 20 μA.

TABLE 1

| | Resistance Value of Conductive Brush Rb (Ω) | Resistance Value of Intermediate Transfer Belt Ri (Ω) | Potential Difference in Conductive Brush Vb (V) |
|---|---|---|---|
| No. 1 | $1\times10^5$ | $1\times10^7$ | 1 |
| No. 2 | $1\times10^7$ | $1\times10^7$ | 100 |
| No. 3 | $1\times10^9$ | $1\times10^7$ | 10000 |
| No. 4 | $1\times10^{10}$ | $1\times10^7$ | 100000 |

In No. 1, where the resistance value Rb of the conductive brush 16 is $1\times10^5\Omega$ and the resistance value Ri of the intermediate transfer belt 10 is $1\times10^7\Omega$, the relationship Rb<Ri illustrated in FIG. 7B is satisfied. When constant current control is performed such that a current of 10 μA flows, the potential difference Vb in the conductive brush 16 is $(1\times10^5\Omega)\times(10\ \mu A)=1$ V and very little voltage drop occurs. The potential difference Vi in the intermediate transfer belt 10 is $(1\times10^5\Omega)\times(10\ \mu A)=100$ V.

That is, to perform constant current control such that a current of 10 μA flows, the brush high-voltage power supply 60 outputs 101 V to the conductive brush 16, where the voltage drops only by 1 V out of 101 V. Thus, as described with reference to FIG. 7B, the adhesion of secondary-transfer residual toner is concentrated on the end of the conductive brush 16.

In the configuration of No. 1, if constant current control is performed, for example, such that a current of 1000 μA flows, a potential difference in the conductive brush 16 is 100 V. However, when constant current control is performed on the conductive brush 16 such that a current of 1000 μA flows, excessive discharge may occur between the conductive brush 16 and the intermediate transfer belt 10 and may cause the secondary-transfer residual toner to scatter inside the apparatus. Additionally, the excessive discharge may cause the intermediate transfer belt 10 to be excessively charged and may affect the performance of primary transfer when the intermediate transfer belt 10 passes through the primary transfer nip on the downstream side. If the secondary-transfer residual toner is charged excessively, a defective image may be generated when the secondary-transfer residual toner positively charged by the conductive brush 16 is moved from the intermediate transfer belt 10 to the photosensitive drum 1, simultaneously with primary transfer from the photosensitive drum 1 onto the next recording material. This is because since the amount of secondary-transfer residual toner charged by the conductive brush 16 is too large, the secondary-transfer residual toner is recovered to the photosensitive drum 1*a* together with toner originally intended to be transferred by primary transfer, and thus toner originally intended to form an image disappears. Therefore, when Rb<Ri, it is difficult to perform both the function of charging and recovering the secondary-transfer residual toner from the intermediate transfer belt 10 and the function of recovering the secondary-transfer residual toner to the root of the conductive brush 16.

In No. 2, where the resistance value Rb of the conductive brush 16 is $1\times10^7\Omega$ and the resistance value Ri of the intermediate transfer belt 10 is $1\times10^7\Omega$, the relationship Ri≤Rb representing the configuration of the present embodiment is satisfied. When constant current control is performed such that a current of 10 μA flows, the potential difference Vb in the conductive brush 16 is 100 V and a voltage drop occurs in the conductive brush 16. The potential difference Vi in the intermediate transfer belt 10 is $(1\times10^5\Omega)\times(10\ \mu A)=100$ V. That is, when Ri=Rb, the potential difference Vb in the conductive brush 16 is the same as the potential difference Vi in the intermediate transfer belt 10. In this case, since the potential difference generated in the conductive brush 16 is substantially the same as that generated in the intermediate transfer belt 10, the potential difference generated in the intermediate transfer belt 10 can be prevented from becoming dominant. This makes it possible to suppress concentration of adhesion of secondary-transfer residual toner on the tip of the conductive brush 16.

Thus, since an attractive force that electrostatically attracts toner increases, the secondary-transfer residual toner can adhere to the roots of the conductive fibers 16*a*.

In No. 3, where the resistance value Rb of the conductive brush 16 is $1\times10^9\Omega$ and the resistance value Ri of the intermediate transfer belt 10 is $1\times10^7\Omega$, the relationship Ri≤Rb representing the configuration of the present embodiment is satisfied as in No. 2. Therefore, when constant current control is performed such that a current of 10 μA flows, the potential difference Vb in the conductive brush 16 is 10000 V and a voltage drop that occurs in the conductive brush 16 is 100 times a voltage drop (100 V) that occurs in the intermediate transfer belt 10. Thus, since an attractive force that electrostatically attracts toner increases as in No. 2, the secondary-transfer residual toner can adhere to the roots of the conductive fibers 16*a*.

In No. 4, where the resistance value Rb of the conductive brush 16 is $1\times10^{10}\Omega$ and the resistance value Ri of the intermediate transfer belt 10 is $1\times10^7\Omega$, the relationship Ri≤Rb representing the configuration of the present embodiment is satisfied. However, when constant current control is performed such that a current of 10 μA flows, the potential difference Vb in the conductive brush 16 is 100000 V. That is, to allow a current of 10 μA to flow in the system of No. 4, the brush high-voltage power supply 60 needs to apply a voltage of 100100 V. This requires an increased capacity of the high-voltage power supply.

As described above, in the present embodiment, using the conductive brush 16 higher in resistance than the intermediate transfer belt 10 makes it possible to cause a large voltage drop in the conductive brush 16, so that the secondary-transfer residual toner can be recovered using the roots of the conductive fibers 16*a*. Thus, in the present embodiment, even when charged secondary-transfer residual toner adheres to the brush member, it is possible to suppress concentration of the adhering secondary-transfer residual toner on the end of the brush member. It is thus possible to efficiently recover the secondary-transfer residual toner from the intermediate transfer member.

The secondary-transfer residual toner adhering to the conductive brush 16 is moved from the conductive brush 16 to the intermediate transfer belt 10 by executing a discharge mode. The discharge mode can be performed after completion of a printing operation on the recording material P, or between successive printing operations on recording materials. When the discharge mode is executed, a voltage having a polarity (or negative polarity in the present embodiment) opposite that of a voltage for charging is applied to the conductive brush 16. Thus, the secondary-transfer residual toner of negative polarity adhering to the conductive brush 16 is moved to the intermediate transfer belt 10. The secondary-transfer residual toner on the intermediate transfer belt 10 is moved from the intermediate transfer belt 10 to the photosensitive drum 1 by applying, to the primary transfer roller, a voltage having a polarity (or negative polarity in the present embodiment) opposite that of a voltage for primary transfer. This makes it possible to remove the secondary-transfer residual toner from the conductive brush 16 and to prepare for the next image formation.

Although constant current control is used in the present embodiment to control the conductive brush 16, the present embodiment is not limited to this. For example, the same effect can be achieved even with constant voltage control.

Next, a description of a second embodiment will herein be described below. In a configuration of an image forming apparatus used in the present embodiment, the same components as those in the first embodiment are given the same reference numerals and their description will be omitted. The dimensions and arrangement of the conductive brush 16, which serves as a charging unit for charging secondary-transfer residual toner, are the same as those in the first embodiment.

Figure 8:
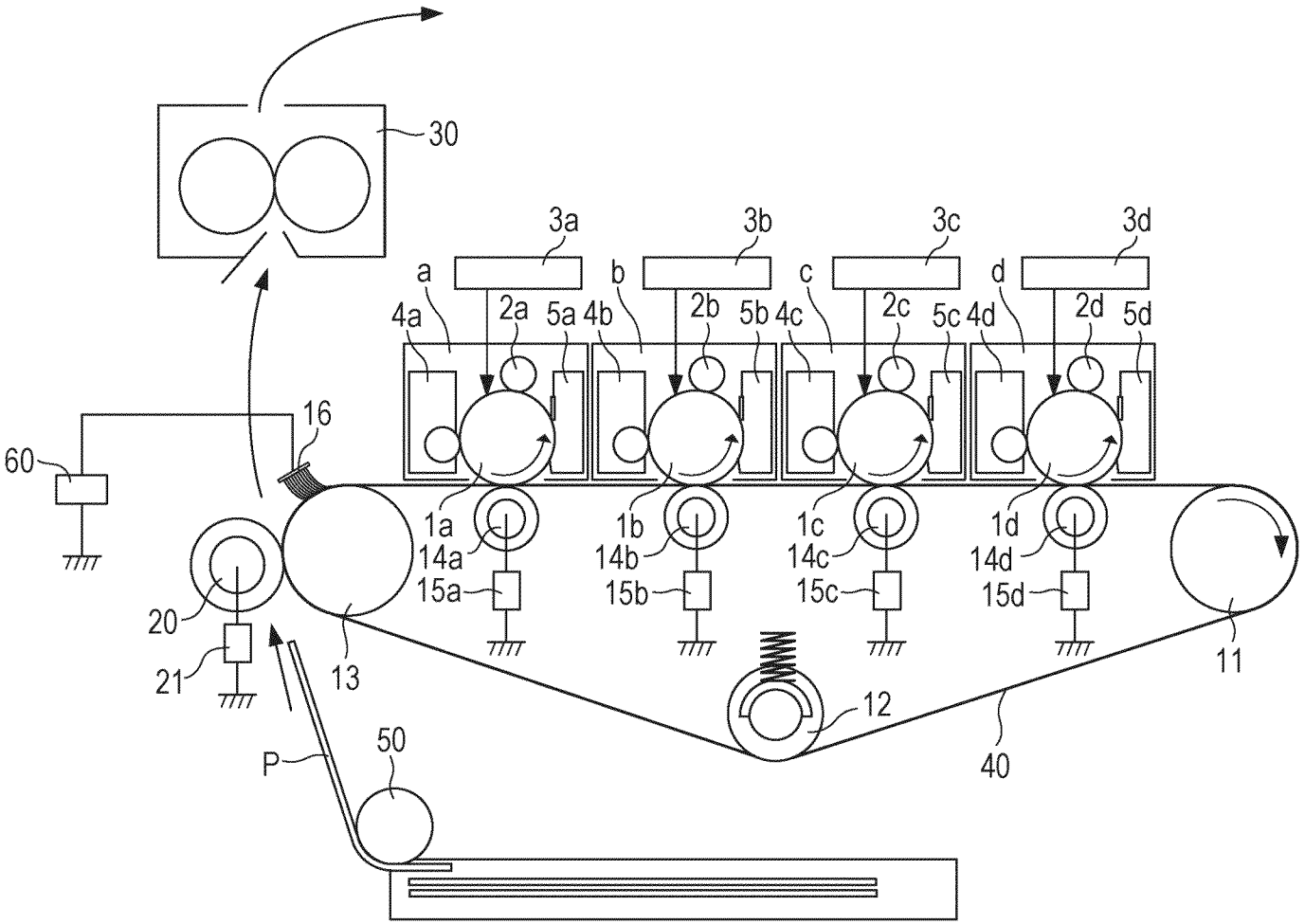
FIG. 8 illustrates an example image forming apparatus according to a second embodiment.

In the configuration of the first embodiment described above, the conductive brush 16 and the conductive roller 17 are used as a charging unit for charging the secondary-transfer residual toner. A major characteristic of the present embodiment is that there is a coating layer on the surface of the intermediate transfer belt 10, and that this makes it possible to use only the conductive brush 16 as a charging unit for charging the secondary-transfer residual toner, as illustrated in FIG. 8.

Figure 9:
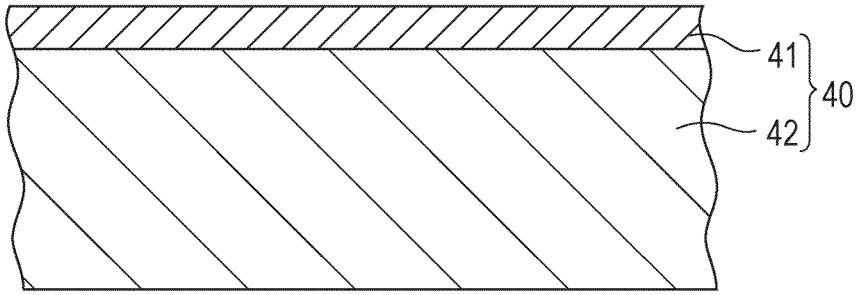
FIG. 9 illustrates an example intermediate transfer belt according to an embodiment.

As illustrated in FIG. 9, an intermediate transfer belt 40 used in the present embodiment has a two-layer structure composed of a coating layer 41 and a base layer 42. The coating layer 41 is a layer with a high degree of smoothness formed by applying a 2-μm-thick acrylic resin coating to the surface. The base layer 42 is made primarily of polyester. The intermediate transfer belt 40 has a thickness of 90 μm, which is equal to the thickness of the intermediate transfer belt 10 of the first embodiment.

The volume resistivity of the intermediate transfer belt 40, that is, a resistance value of the intermediate transfer belt 40 including the coating layer 41 is $1\times10^{9}$ Ω·cm, as in the first embodiment. The resistance value Ri of the intermediate transfer belt 40 at a portion where the intermediate transfer belt 40 is in contact with the conductive brush 16 is $1.0\times10^{6}$Ω, also as in the first embodiment.

The coating layer 41, which is thinner in thickness than the base layer 42, has no significant impact on the resistance value Ri of the intermediate transfer belt 40. However, the resistance may be adjusted, as necessary, by adding a conductive agent such as carbon black. The thickness of the coating layer 41 preferably ranges from 0.5 μm to 4.0 μm for better smoothness and convenience in manufacture.

Examples of resin material applied to the coating layer 41 include, but are not particularly limited to, polyester, polyether, polycarbonate, polyarylate, urethane, silicone, and fluororesin. The base layer 42 may be made of any thermoplastic resin. For example, the material of the base layer 42 may be polyimide, polycarbonate, polyarylate, acrylonitrile-butadiene-styrene (ABS) copolymer, polyphenylene sulfide (PPS), polyvinylidene fluoride (PVdF), or a mixture of some of these resins.

The conductive brush 16 is made of the same material as in the first embodiment. The resistance value of one conductive fiber 16*a* per unit length is $1\times10^{12}$ Ω/cm. The conductive brush 16 has a resistance value Rb of $1\times10^{8}$Ω, a single yarn fineness of 300 T/60 F (5 dtex), and a brush density of 100 kF/inch$^2$.

In the configuration described above, as in the first embodiment, the relationship Rb≥Ri is satisfied, where Rb (Ω) is a resistance value of the conductive brush 16 and Ri (Ω) is a resistance value of the intermediate transfer belt 40 in an area where the intermediate transfer belt 40 is in contact with the conductive brush 16.

A function of the second embodiment will now be described. In the first embodiment described above, using the conductive brush 16 higher in resistance than the intermediate transfer belt 10 causes a voltage drop in the conductive brush 16 and improves recovery performance of the conductive brush 16. The second embodiment has the same function as this and thus, the description of this function will be omitted here.

In the intermediate transfer belt 40 of the present embodiment, the coating layer 41 serves as a surface layer to reduce unevenness formed in the base layer 42 during manufacture. This makes it possible to realize the intermediate transfer belt 40 having a smooth surface layer. The improved smoothness of the coating layer 41 of the intermediate transfer belt 40 can reduce very small spaces created between the intermediate transfer belt 40 and a surface of a recording material. Thus, it is possible to suppress disturbance in an electric field in the secondary transfer nip and improve efficiency of secondary transfer.

This can reduce the amount of secondary-transfer residual toner and make it possible to recover secondary-transfer residual toner to the root of the conductive brush 16. Therefore, even if the conductive brush 16 is the only component for charging the secondary-transfer residual toner, it is possible to recover the secondary-transfer residual toner from the intermediate transfer belt 40. Thus, in the present embodiment, even when charged secondary-transfer residual toner adheres to the brush member, it is possible to suppress concentration of the adhering secondary-transfer residual toner on the end of the brush member. It is thus possible to efficiently recover the secondary-transfer residual toner from the intermediate transfer member.

With the configuration in which the intermediate transfer belt 40 includes the coating layer 41 serving as a surface layer, it is possible to improve the performance of secondary transfer and reduce the amount of toner to be positively charged by the conductive brush 16. Thus, since good cleaning performance can be achieved only with the conductive brush 16, the size and cost of the image forming apparatus can be reduced.

According to the present invention, when secondary-transfer residual toner is charged, even if the secondary-transfer residual toner adheres to the brush member, it is possible to suppress concentration of the adhering secondary-transfer residual toner on the end of the brush member and efficiently recover the secondary-transfer residual toner from the intermediate transfer member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2011/074761, filed Oct. 27, 2011, which is hereby incorporated by reference herein in its entirety.

What is claimed is:

1. An image forming apparatus comprising:

an image bearing member configured to bear a toner image;

a moveable intermediate transfer member, the intermediate transfer member being used for secondarily-transferring a toner image primarily-transferred from the image bearing member at a primary transfer portion onto a recording material at a secondary transfer portion;

a brush member configured to come into contact with residual toner remaining on the intermediate transfer member without being secondary-transferred to the recording material at the secondary transfer portion; and a power supply unit configured to apply a voltage to the brush member, wherein the residual toner is charged by the brush member to which a voltage of a predetermined polarity is applied by the power supply unit, and the charged residual toner is moved from the intermediate transfer member to the image bearing member at the primary transfer portion, the brush member includes a supporting unit fixed without being moved during moving of the intermediate transfer member, and a plurality of conductive fibers supported by the supporting unit and sliding over the intermediate transfer member, and the brush member recovers the residual toner from the intermediate transfer member and keeps the residual toner by contacting the residual toner to roots of conductive fibers according to a potential difference generated between tips and roots of the conductive fibers.

2. The image forming apparatus according to claim 1, wherein the relationship $Rb \leq Ri$ is satisfied, where Rb (Ω) is a resistance value of the brush member and Ri (Ω) is a resistance value of the intermediate transfer member at a contact portion in contact with the brush member.

3. The image forming apparatus according to claim 1, wherein the intermediate transfer member is an endless intermediate transfer belt.

4. The image forming apparatus according to claim 3, wherein a surface of the intermediate transfer belt over which the brush member slides is formed by a coating layer.

5. The image forming apparatus according to claim 1, wherein the power supply unit applies a direct-current voltage to the brush member.

6. The image forming apparatus according to claim 1, wherein a volume resistivity of the intermediate transfer member is higher than or equal to $1\times10^{8}$ Ω·cm and lower than $1\times10^{10}$ Ω·cm.

7. The image forming apparatus according to claim 1, wherein when image formation is performed successively on a plurality of recording materials, the residual toner charged by the brush member is moved from the intermediate transfer member to the image bearing member simultaneously with transfer of a toner image formed on the image bearing member from the image bearing member to the intermediate transfer member.

8. The image forming apparatus according to claim 1, wherein the image bearing member is arranged in plurality along a rotational direction of the intermediate transfer member.

9. The image forming apparatus according to claim 1, further comprising a primary transfer member configured to form a primary transfer portion together with the image bearing member, with the intermediate transfer member interposed therebetween, to primary-transfer the toner image from the image bearing member to the intermediate transfer member.

10. The image forming apparatus according to claim 1, further comprising a secondary transfer member configured to form a secondary transfer portion together with the intermediate transfer member to secondary-transfer the toner image from the intermediate transfer member to a recording material.

11. The image forming apparatus according to claim 1, wherein the brush member slides over the intermediate transfer member at a tips side of the conductive fiber.

12. The image forming apparatus according to claim 1, wherein the brush member recovers the residual toner from the intermediate transfer member at tips side of the conductive fiber.

13. A method comprising:

applying a toner image to an image bearing member;

applying a voltage of a predetermined polarity to a brush member;

transferring the toner image from the image bearing member to a moveable intermediate transfer member at a primary transfer portion;

transferring the toner image from the intermediate transfer member onto a recording material at a secondary transfer portion;

contacting a brush member with residual toner remaining on the intermediate transfer member without being transferred to the recording material at the secondary transfer portion, wherein the residual toner is charged by the brush member, and wherein the brush member recovers the residual toner from the intermediate transfer member and keeps the residual toner by contacting the residual toner to roots of conductive fibers according to a potential difference generated between tips and roots of the conductive fibers; and moving the charged residual toner from the intermediate transfer member to the image bearing member at the primary transfer portion.

* * * * *